United States Patent [19]

Manney et al.

[11] Patent Number: 5,048,841

[45] Date of Patent: Sep. 17, 1991

[54] SIMULATED RACING BOARD GAME AND METHODS OF UTILIZING SAME

[75] Inventors: Rodney A. Manney, Marine City; Milton V. Manney; Bruce I. Manney, both of Pontiac, all of Mich.

[73] Assignee: Bar M. Company, Pontiac, Mich.

[21] Appl. No.: 526,023

[22] Filed: May 21, 1990

[51] Int. Cl.[5] ..... A63F 9/14

[52] U.S. Cl. ..... 273/246

[58] Field of Search ..... 273/243, 246, 248, 249, 273/303, 304, 305, 306

[56] References Cited

U.S. PATENT DOCUMENTS

| | | | |
|---|---|---|---|
| 1,463,871 | 8/1923 | Chisolm | 273/246 |
| 1,519,422 | 12/1924 | Taylor | 273/243 |
| 1,583,488 | 5/1926 | Pauer | 273/246 |
| 1,797,742 | 3/1931 | Ward | 273/246 |
| 2,062,168 | 11/1936 | Entwistle | 273/246 |
| 2,223,175 | 11/1940 | Ink | 273/243 |
| 3,414,264 | 12/1968 | Schriber | 273/248 |

FOREIGN PATENT DOCUMENTS

| | | | |
|---|---|---|---|
| 994674 | 11/1951 | France | 273/246 |
| 1465782 | 12/1966 | France | 273/246 |
| 1528618 | 6/1968 | France | 273/246 |
| 253493 | 3/1948 | Switzerland | 273/246 |

*Primary Examiner*—Edward M. Coven
*Assistant Examiner*—William E. Stoll
*Attorney, Agent, or Firm*—Irving M. Weiner; Joseph P. Carrier; Robert M. Petrik

[57] ABSTRACT

A racing board game apparatus for use by a plurality of players which comprises a game board having a simulated race course of depicted thereon, including a plurality of racing lanes, a plurality of playing pieces each representing a player for movement along the simulated race course, a random number generator for determining a sequential playing order to be followed by the players in turn, and cards for determining a plurality of potential movements of each playing piece at a given turn. Each of the racing lanes is divided into a plurality of discreet, sequential playing spaces and each racing lane is designated as one of the four suits in a standard deck of playing cards. The determining cards include at least one deck of standard playing cards to be distributed to and strategically discarded by the players throughout the course of a game for determining movements of the playing pieces along the simulated race course. A suit of each playing cards determines which lane a playing piece may be moved in, and a facial designation of each playing card determines a number of spaces by which a playing piece may be moved in a given lane.

20 Claims, 2 Drawing Sheets

SIMULATED RACING BOARD GAME AND METHODS OF UTILIZING SAME

BACKGROUND OF THE INVENTION

1. Field of the Invention

The present invention relates to board games with a racing theme, and methods of using same. More particularly, the present invention relates to a racing board game in which a plurality of players strategically race to the finish along a simulated race course having a number of racing lanes. Each of the racing lanes is designated as one of the four suits in a standard deck of playing cards, and at least one deck of standard playing cards is used as the primary means for determining each player's potential movements along the simulated race course.

2. Description of Relevant Art

There are known board games in which players sequentially move playing pieces around a simulated race course in a race to the finish. Some known racing board games are, for example, disclosed in U.S. Pat. Nos. 1,583,488 entitled "RACING GAME", 4,057,254 entitled "APPARATUS FOR PLAYING A HORSE-RACING GAME", 4,357,017 entitled "AUTO RACING GAME WHEREIN A NUMBERED ARRAY AND PLAYER-ACTUATED DISCS DETERMINE RACE CAR MOVEMENT", and 4,874,177 entitled "HORSE RACING GAME".

Known racing board games, as exemplified by the above patents, are generally disadvantageous because (1) they are relatively complex and involved to learn; (2) they take a relatively long time to play; and/or (3) they are not sufficiently, strategically involved, and correspondingly players lose interest. For example, the horse racing game disclosed in U.S. Pat. No. 4,874,177 attempts to mimic many aspects of an actual horse race by incorporating horse performance cards bearing personal information regarding actual horses, a number matrix referring to a horse's performance in an actual (previous) racing event, tables by which variable conditions of an actual horse racing event may be taken into account, and a race record for charting the progress and outcome of the simulated horse race. As will be understood, these several features make the game relatively complex and involved. The racing game disclosed in U.S. Pat. No. 1,583,488, on the other hand has only a limited element of strategy involved therewith and may become uninteresting to players; while the racing game disclosed in U.S. Pat. No. 4,357,017 has substantially no strategy involved therewith, but instead permits playing pieces to be randomly moved around a race track based on the player's manipulation of tiddlywink type devices. Still further, U.S. Pat. No. 4,057,254 merely discloses a horse racing board game for a plurality of players in which each player has a marker that moves along slots defined in the surface of the game board, but no directions or rules are provided for controlling movement of the markers around the board.

Known racing board games, including those discussed above, have thus failed as a whole to provide a racing board which is relatively simple in construction, simple to lean, significantly strategically involved, and can be played to completion in a relatively short time.

SUMMARY OF THE INVENTION

The present invention has been designed to overcome the disadvantages of known racing games, and to thereby provide a board game having all of the desirable attributes discussed above.

According to the present invention there is provided a racing board game apparatus for use by a plurality of players which comprises a game board having a simulated race depicted thereon, including a plurality of adjacent racing lanes, a plurality of playing pieces each representing a player for movement along said simulated race course, means for randomly determining a sequential playing order to be followed by the players in turn, and means for determining a plurality of potential movements of each playing piece at a given turn. Each of the racing lanes is divided into a plurality of discreet, sequential playing spaces, and each racing lane is designated as one of the four suits in a standard deck of playing cards. The determining means includes at least one deck of standard playing cards to be randomly distributed to and strategically discarded by the playing cards to be randomly distributed to and strategically discarded by the players through the course of a game for determining movements of the playing pieces along the simulated race course. A suit of each playing card determines which lane a playing piece may be moved, in and a facial designation of each playing card determines a number of spaces by which a playing piece may be moved in a given lane.

It is an object of the present invention to provide a racing board game which combines several elements of chance with several elements of strategy to achieve an interesting, fast moving race to the finish.

It is another object of the present invention to provide such a racing board game having a relatively small number of rules which can be readily understood by most persons, even those with little or no familiarity with racing.

It is a further object of the present invention to provide such a board game which is comprised of a limited number of simple components, most of which are conventionally known readily available.

It is still another object of the present invention to provide such a racing board game which can be played by a number of players in a relatively short time, such as 30 minutes less.

Other objects, advantages and salient features of the present invention will become apparent from the following detailed description, when taken in conjunction with the annexed drawings, discloses a preferred embodiment of the present invention.

DETAILED DESCRIPTION OF THE PREFERRED EMBODIMENT

Figure 1:
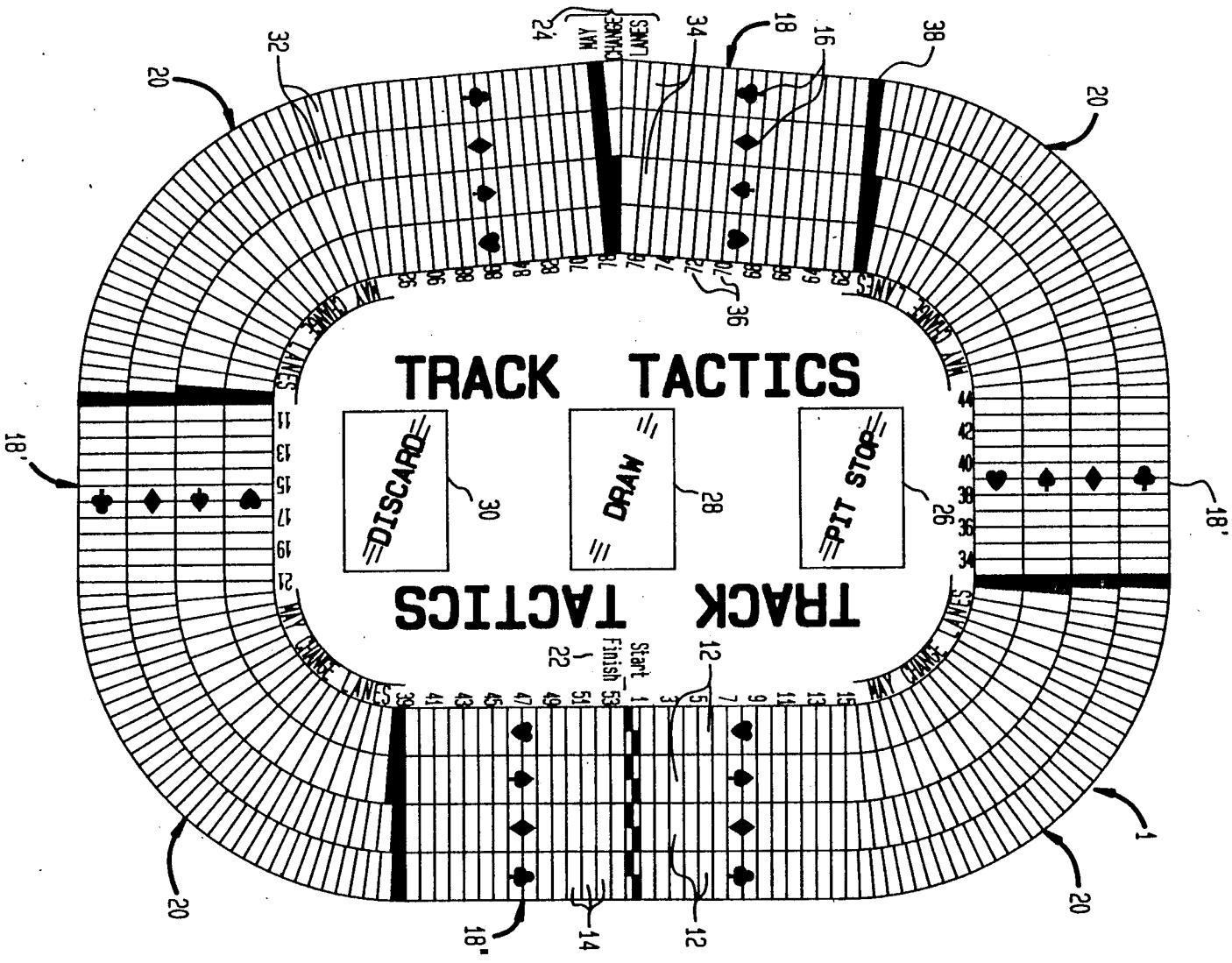
FIG. 1 is a plan view of a game board according to a preferred embodiment of the present invention.

As shown in FIGS. 1–5, there are five primary components of a racing board game according to the preferred embodiment of the present invention, including a game board 1, a plurality of playing pieces 2, a random number generator 4 such as a pair of dice, at least one deck 6 of standard playing cards, and a plurality of pit stop cards 8.

Referring to FIG. 1, the gameboard 1 has a simulated race track depicted thereon, including a plurality of adjacent racing lanes 12. As depicted the simulated race track preferably includes four of the racing lanes 12, each of which is designated (at 16) as different one of the four suits in a standard deck of playing cards for reasons discussed further hereinbelow, and each of which is divided into a plurality of discreet, sequential playing spaces 14 along which the playing pieces 2 (see FIG. 2) will be moved during a game. The simulated race course is preferably arranged as a substantially oval, track, while the racing lanes 12 are respectively disposed from inner to outer portions of the oval in a manner similar to actual racing courses. Additionally, each of the racing lanes 12 includes a plurality of straightaway areas 18, 18', 18" and a plurality of curved areas 20, 20' which are generally arranged in an alternating manner. More particularly, each racing lane includes four curved areas 20 disposed at the four corners of the race track, a short dog leg curve 20', a pair of longer straightaway sections 18, a pair of shorter staightaway sections 18', and a very long straightaway section 18".

The very long staightaway section 18" has a start/finish line 22 disposed at a mid portion thereof, while the pair of longer straightaway sections 18 has the short dog leg curve 20' provided at a mid portion thereof.

As depicted, a number of playing spaces 14 in corresponding straightaway areas 18, 18', 18" is equal for all of the racing lanes 12, while a number of spaces 14 in corresponding curved areas 20, 20' of the racing lanes 12 generally increases from an innermost lane to an outermost lane. Particularly, the inner two lanes 12 (those designated as spades and hearts) have the same number of spaces along their entire length, the lane 12 designated as diamonds has an increased number of spaces 14 in the cruved areas 20, 20' thereof in comparison to the corresponding curved areas of the inner two lanes, the lane 12 designated as clubs has an increased number of spaces in the curved areas 20 thereof in comparison to the corresponding curved areas 20 of the diamonds lane, and the clubs and diamonds lanes have the same number of spaces in the dog leg sections 20' thereof.

Due to the unequal numbers of spaces in the curved areas 20, 20' of the respective lanes 12, any given space 14 in a curved section 20, 20' of the spades, diamonds and clubs lanes may not directly align with the space(s) in the lane(s) adjacent thereto. At certain intervals, however, corresponding spaces 14 in the curved sections 20 of adjacent lanes 12 will preferably be aligned, such as shown by the lines which extend fully radially outwardly from the third, sixth, ninth, etc. spaces of a curved section 20 of the hearts lane to the sixth, twelfth, eighteenth, etc. spaces of the corresponding section 20 of the clubs lane. Such varying alignment of the spaces will affect the ability of one playing piece to spin out another playing piece, as discussed further hereinbelow.

Indicated at 26 is a discard area for the pit stop cards 8 during the course of a game.

Indicated at 28 is an area for placing an undistributed portion of the standard playing deck 6 during a game, while indicated at 30 is a discard area for the standard playing cards, which will be discarded by the players during the course of a game.

For convenience, indicia 32 may be provided in the curved areas 20, 20' of each racing lane 12 to indicate the remaining number of spaces 14 remaining in that curved area 20, 20' of a lane 12; indicia 36 may be provided on the inside of the innermost racing lane 12 indicating the number of spaces in such lane; and indicia 38 may be provided to indicate the last space of a curved area 20, 20' of each racing lane 12.

Figure 2:
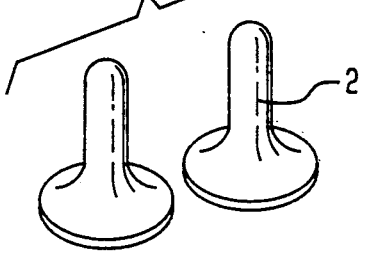
FIG. 2 depicts exemplary playing pieces.
Figure 3:
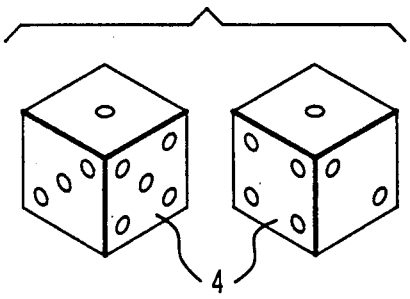
FIG. 3 depicts a pair of dice.

Although only two playing pieces 2 are shown in FIG. 2, it is preferred that the number of playing pieces provided with the game will be 4, 8, or a further multiple of 4, corresponding to the number of suits in a standard playing deck. Also, the playing pieces could be shaped as racing cars, racing animals such as horses or dogs, racing boats, etc. Also, the playing pieces could be shaped as racing cars, racing animals such as horses or dogs, racing boats, etc. Relatedly, although only four racing lanes 12 are depicted, it will be understood that the gameboard 1 could include more such racing lanes, such as 8, 12, etc.

Figure 4:
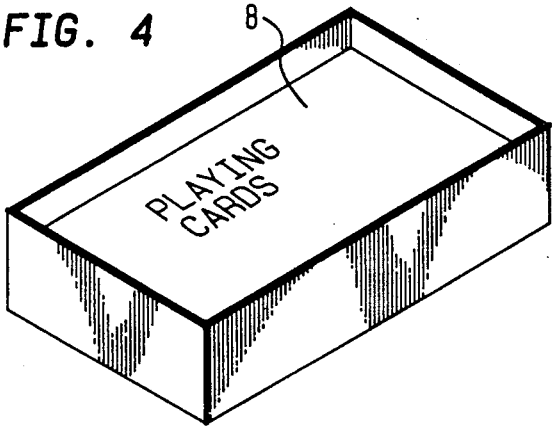
FIG. 4 depicts a standard deck of playing cards.
Figure 5:
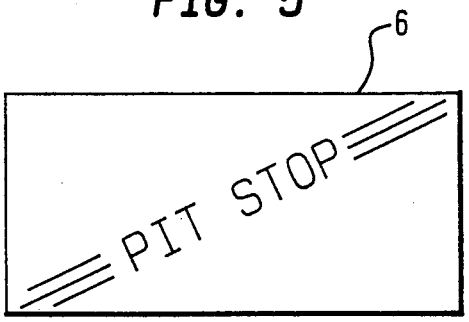
FIG. 5 depicts a pit stop card to be used in the preferred embodiment of the invention.

Similarly, although only one deck of standard playing cards 6 is shown in FIG. 4, it will be understood that additional decks of cards could be used with the racing board game. It is preferably that at least two decks of playing cards will be utilized when three or more players are playing the game. Moreover, it is preferred that the jokers in the standard deck of playing cards 6 will be kept in the deck and distributed to the players during the course of a game together with the other cards in the deck, and such jokers will function as wild cards as discussed further hereinbelow.

The racing board game will preferably include a small number of the pit stop cards 8, such as one or two pit stop cards for each playing piece 2. The pit stop cards 8 will preferably be distributed to all players on a limited basis, such as one card distributed to each player at the beginning of a game, and the pit stop cards 8 can be selectively, strategically utilized by players to permit a playing piece to be moved on successive turns as discussed further hereinbelow.

The playing cards 6 and the pit stop cards 8 collectively function as means for determining a plurality of potential movements of each playing piece at a given player's turn.

The pair of dice 4 are used at the beginning of a game to randomly establish a sequential playing order to be followed by the players in turn throughout the course of a game, and will also be utilized to establish the ability of a playing piece to continue movement after being wrecked or spun by another playing piece, as discussed further hereinbelow.

OPERATON OF PLAY

When starting a game, the players arrange themselves around the gameboard 1 so that all players can reach draw cards as placed on the space 28. Each player then rolls the pair of dice 4 randomly determine a sequential playing order to be followed by the players in turn. For example the player rolling the highest numerical value on the pair of dice will be designated as a dealer, and the playing order will begin with the player to the dealer's left and continue clockwise around the gameboard 1. The dealer then deals a plurality of cards, such as 7,to each player so that each player will have an initial playing hand, and then the dealer will place the remaining portion of the deck 6 on the draw space 28. The dealer will also also distribute a limited number of pit stop cards 8, such as one, to each player.

To begin play, the player to the left of the dealer, or whichever player is designated to go first in the sequential order of play, will select one of the cards in the player's hand and place it face up on the discard space 30 on the gameboard 1. A suit of the playing card thus discarded determines which lane 12 the player's playing piece may initially be moved in, and the facial designation of the playing card thus discarded determines a number of spaces by which the player's playing piece 2 may be moved forwardly in the lane 12. For example, if the discarded card is a three of spades the player's playing piece may be moved from the start/finish line 22 three spaces forwardly in the lane 12 designated as spaces. The jacks, queens and kings of the standard playing deck may be assigned any desired facial value such as ten. Relatedly, the aces in the standard deck of playing cards may be assigned alternative, high or low facial values, such as one or fifteen, to be selectively decided by the player discarding same. Either before the player moves his or her playing piece or at the end of the player's turn he or she will draw a replacement card into his or her hand from the remaining portion of the deck 6 positioned on the draw space 28. In this regard, however, it is preferred that a player may be prevented from drawing a replacement card into his or her hand if the player forgets to do so in a timely manner, i.e. before the next player casually proceeds with his or her turn. In such situations the forgetful players will be at a disadvantage because they will have less cards in their hands, and will thus have a fewer potential moves for their playing pieces 2 at each turn. The next player in the sequential order of play then may take a similar turn for moving his or her player along the simulated race track.

As one of the primary elements of strategy in the game, a playing piece 2 is normally restricted to movements in a lane 12 in which the playing piece is already disposed whenever the playing piece is in a straighway section 18, 18', 18'' of the racing lane. When a playing piece is in a curved section 20, 20' of a racing lane 12, however, the playing piece may be freely moved to a directly adjacent lane when a player discards a card of a suit corresponding to the designated suit of the adjacent lane. Thus, if a player's playing piece 2 is in a straightaway section 18, 18' 18'' of the spades lane 12, the playing piece cannot normally be moved forwardly unless the player has a card of spades to discard. On the other hand, if the playing piece is in a curved section 20 of the spades lane 12, the playing piece may be selectively moved forwardly in the spades lane, the diamonds lane or the hearts lane as long as the player has a spade, diamond or heart to discard. In situations where the spaces 14 in the curved areas 20 of adjacent lanes 12 do not align, as discussed above, and where a playing piece is being moved to an adjacent lane, the piece should be initially moved to the forwardmost space of the adjacent lane which overlaps to any extent with the space 14 in which the piece is initially disposed, and then the piece should be moved forwardly according to the facial designation of the discard. If a player runs out of cards in the lane or lanes where the playing piece may move, the player merely discards a card and draws another to replace it, but does not move his or her playing piece 2 forwardly.

Also, as discussed above, it is preferred that the jokers of the standard playing deck will be utilized as wild cards and will be distributed to the players along with all other cards in the standard playing deck 6. The jokers may be selectively discarded by a player at the player's turn to permit the player's piece to be moved radially or laterally from a space 14 anywhere in a lane 12, i.e. in either a straightaway area or a curved area, to a corresponding space in an adjacent lane.

As discussed above, an ace has alternative, selectable facial designations. Normally it will be desirable to select the higher facial for an ace because it will usually be more desirable to move a playing piece 2 further forwardly toward the finish line 22. When a piece is positioned in the dogleg curve 20', however, an ace could be advantageously used to change from one lane to an adjacent lane while remaining in the dogleg so that the playing piece could be moved to still another lane in the player's following turn. It is preferable to have the higher facial designation of an ace as 15 because this value corresponds to the number of spaces in a longer straightaway section 18.

The pit stop cards 8 function as multiple-play indicators and may be selectively discarded by the players at any of the player's playing turns to permit a playing piece to be moved on successive turns. More particularly, at a player's turn he or she may discard his or her pit stop card on the designated space 26, which then permits the player to select two cards from his or her hand, discard the two cards on the designated space 30, move his or her playing piece 2 corresponding to both of the cards which were discarded, and then select two replacement cards from the draw space 28. Such movement of a playing piece 2 on successive turns not only permits the playing piece to be moved forward more quickly, but also can be strategically utilized when wrecking or spinning an opposing player's piece 2, as discussed below.

To wreck another player's piece 2, a given player's piece must land on the same space 14 in the same lane 12 as the opposing player's piece. This results in the opposing player losing a plurality playing turns, such as three. However, on each of the other player's lost turns he or she is preferably permitted to roll the pair of dice 4 a single time, and if he or she rolls doubles in any of the three turns the player is considered to brought out of the wreck and may from that point on continue taking his or her normal turns. Further, it is preferred that if a player rolls doubles on a first turn after his or her playing piece is wrecked, the player who caused the wreck is then himself or herself wrecked and loses his or her next three turns. In such situation the first player, whose piece is now wrecked, may also roll the dice 4 on each of the lost turns to see if he or she can roll doubles and correspondingly continue the race before the end of the three turns. If a wrecked player does not roll doubles at any of the turns, the player may still (at each of the three turns) discard one of the cards from his or her hand and draw a replacement card from the space 28 to try and better his or her hand.

To spin out another player's piece 2 a first player must move his or her piece to a space 14 in a lane 12 which is directly aligned with a space 14 of an adjacent lane 12 occupied by the other player's piece. For example, if a first player's piece is situated at the space designated 47 in a straightaway area 18 of the spades column, that piece could be spun out by another player who lands his or her piece on the aligned space 47 in the hearts lane. On the other hand, it is possible to spin out another player's piece 2 in a curved area 20, 20' of a lane only when the other player's piece is on a space which can be directly aligned with, as discussed above. A spin out preferably results in loss of only one playing turn, and may be overcome by rolling the dice 4 in the same manner as discussed in relation to a wreck.

In situations where a playing piece has been wrecked or spun, it is not possible to wreck or spin out the opposing player's piece which caused the wreck or spin out unless such other player's piece is still situated on the same space (where the piece has been wrecked) or in a directly aligned space in an adjacent lane (where the piece has been spun out). Thus, the only safe way to wreck or spin out another player is to use the pit stop card 8. Particularly, a first card can be discarded onto the space 30 for wrecking or spinning out another player's piece, and then a second card can be discarded onto the space 30 to escape the possibility of being wrecked or spun out if the other player rolls doubles.

Normally, a first playing piece 2 to complete one full lap and touch the finish line 22 will be considered the winner, although it is also desirable to play games of multiple laps around the race course, such as four or five. With games having 2–4 players, the game of one lap can be completely in approximately 15–30 minutes, while a game of 5 laps can be completed in approximately 1½ to 2 hours. When a game of more than one lap is played further features may be added. As one such feature, it is preferred that the start/finish line 22 will also function as a bonus line for all of the intermediate laps, whereby any playing piece 2 which lands exactly on the line may, at the player's next turn, be freely moved to a corresponding space in any other lane. For example, if a playing piece 2 lands on the bonus line space in the clubs lane 12, at the player's next turn the piece may be laterally shifted to the bonus line space of the hearts, spades or diamonds lanes 12 and then the player can discard an appropriate card of the corresponding suit and move the piece 2 forwardly in the new lane. This is the only situation in which a piece 2 is permitted to skip or jump over lanes. The bonus line desirably breaks up the very long straightaway 18".

As another such feature, an additional pit stop card 8 may be distributed to each player each time their playing piece 2 crosses the start/finish (bonus) line 22 in the intermediate laps; and/or each player may be permitted to add another playing card into his or her hand each time the player's piece 2 crosses the start/finish line in the intermediate laps. These features function to speed up the multiple-lap games, and prevent player from becoming disinterested.

Although there has been described what is at present considered to be the preferred embodiment of the present invention, it will be understood that the invention can be embodied in other specific forms without departing from the spirit or essential characteristics thereof. The described embodiment is, therefore, to be considered in all aspects as illustrative, and not restrictive. The scope of the invention is indicated by the appended claims rather than by the foregoing description.

We claim:

1. A simulated racing board game apparatus for use by a plurality of players, comprising:

a game board having a playing surface provided thereon;

said playing surface having a simulated race course depicted thereon, including a plurality of adjacent racing lanes;

a plurality of playing pieces each representing a player for movement along said simulated race course;

means for establishing a sequential playing order to be followed by said players in turn;

means for determining a plurality of potential movements of each said playing piece at a given player's turn;

each said racing lane being divided into a plurality of discrete, sequential playing spaces, and each said racing lane being designated by one of the four suits in a standard deck of playing cards;

said determining means including at least one deck of standard playing cards to be randomly distributed to and strategically discarded by the players throughout the course of a game for determining movement of said playing pieces along said simulated race course;

suit coding means on each playing card for determing in which lane any player's playing piece may be moved; and a facial designation means on each playing card for determining the number of spaces by which a playing piece may be moved along the racing lane.

2. A board game apparatus according to claim 1, wherein:

each said racing lane including a plurality of free movement sections in which a playing piece may be moved to an adjacent lane when a player discards a card of a suit corresponding to the designated suit of the adjacent lane, and a plurality of restricted movement sections in which a playing piece is normally restricted to movements in a lane in which the playing piece is already disposed.

3. A board game apparatus according to claim 2, wherein;

said free movement sections and said restricted movement sections are arranged in an alternating manner along each said racing lane.

4. A board game apparatus according to claim 3, wherein;

said simulated race course is in an endless track pattern such that each lane includes a plurality of straightaway areas and a plurality of curved areas, said straightaway areas corresponding to said restricted movement sections and said curved areas corresponding to said free movement sections.

5. A board game apparatus according to claim 4, wherein:

said simulated race course is a substantially oval track, and each said lane includes at least four restricted movement sections and four free movement sections.

6. A board game apparatus according to claim 4, wherein:

said racing lanes are respectively disposed from inner to outer portions of said endless track;

corresponding restricted movement sections of respective racing lanes including an equal number of playing spaces; and corresponding free movement sections of respective racing lanes including different numbers of said playing spaces, increasing from an innermost lane to an outermost lane.

7. A board game apparatus according to claim 2, wherein:

each said racing lane further includes a bonus line, and any playing piece which lands on the bonus line is permitted to be moved laterally to a corresponding space in any other lane.

8. A board game apparatus according to claim 1, wherein:

said establishing means is also used for randomly establishing when a playing piece may continue moving along the race course after being hindered by another playing piece.

9. A board game apparatus according to claim 2, wherein:

said determining means further includes wild card means to be randomly distributed to said players together with said standard deck of playing cards, and to be selectively discarded by the players for permitting a playing piece to be free laterally moved from one lane to an adjacent lane while disposed in any section of said one lane.

10. A board game apparatus according to claim 9, wherein:

said wild card means comprises the jokers of a standard deck of playing cards.

11. A board game apparatus according to claim 2, wherein:

said determining means further includes multiple-play indicators to be evenly distributed to all players on a limited basis, and to be selectively utilized by the players to permit a playing piece to be moved on successive turns.

12. A method of playing a racing board game involving a plurality of players, comprising the steps of:

providing a game board having a simulated race course depicted thereon, including a plurality of racing lanes;

dividing each said racing lane into a plurality of discreet, sequential playing spaces;

assigning each player a playing piece to be moved along said simulated race course;

randomly determining a sequential playing order to be followed by the players in turn;

designating each said racing lane as one of the four suits in a standard deck of playing cards;

providing means for determining a plurality of potential movements of each said playing piece at a given turn;

said determining means including at least one deck of standard playing cards to be randomly distributed to and strategically discarded by said players throughout the course of a game for determining movement of said playing pieces along said simulated race course;

the suit of each playing card determining in which lane every player's playing piece may be moved; and the facial designation of each playing card determining the number of spaces by which a playing piece may be moved in the given lane.

13. A method according to claim 12, wherein:

each player is initially, randomly distributed a hand comprising a plurality of said playing cards; and at each said turn a player is normally permitted to selectively discard one of the playing cards in the player's hand, to move the player's piece along the simulated race course based on the suit and facial designation of the discarded card, and to draw into the player's hand another card from the deck of playing cards.

14. A method according to claim 12, wherein:

each said lane is provided with a plurality of free movement sections in which a playing piece may be moved to an adjacent lane when a player discards a card of a suit corresponding to the designated suit of the adjacent lane, and with a plurality of restricted movement sections in which a playing piece is normally restricted to movements in a lane in which the playing piece is already disposed; and said free movement sections and said restricted movement sections are arranged in an alternating manner.

15. A method according to claim 14, wherein:

said simulated race course is depicted as an endless track pattern such that each lane includes a plurality of straightaway areas and a plurality of curved areas; and said straightaway areas being designated as said restricted movement sections, and said curved areas being designated as said free movement sections.

16. A method according to claim 15, wherein:

said simulated race course is a substantially oval track, and each said lane includes at least four restricted movement sections and four free movement sections.

17. A method according to claim 14, wherein:

each said lane is further provided with a bonus line in which a playing piece may be laterally moved to any other racing lane.

18. A method according to claim 13, wherein:

said determining means further includes at least one wild card which is randomly distributed to said players together with said standard deck of playing cards; and the players may selectively discard the wild card during their playing turns for allowing a playing piece to be freely moved from one lane to an adjacent lane while disposed in any section of said one lane.

19. A method according to claim 14, wherein:

said determining means further includes multiple-play indicators which are evenly distributed to all players on a limited basis; and the players may selectively utilize a multiple-play indicator during their playing turns for allowing a playing piece to be moved in successive playing turns.

20. A method according to claim 12, wherein:

each player is permitted to restrict movement of another player's piece for at least one playing turn by moving the player's own piece in close proximity to a lane space occupied by the other player's piece; and providing said other player with a chance means for overcoming said restricted movement of his playing piece and simulataneously restricting movement of said one player's piece for at least one playing turn.

* * * * *

UNITED STATES PATENT AND TRADEMARK OFFICE
CERTIFICATE OF CORRECTION

PATENT NO. : 5,048,841

DATED : September 17, 1991

INVENTOR(S) : Manney et al.

It is certified that error appears in the above-identified patent and that said Letters Patent is hereby corrected as shown below:

Column 1, line 63, change "lean," to --learn,--,
line 68, change "racing games," to --racing board games,---.

Column 2, line 6, after "race" insert --course--,
line 21, change "through" to --throughout--,
line 23, change "moved, in" to --moved in,--,
line 46, change "description, when" to --description, which, when--.

Column 3, line 3, insert "," after --depicted--,
line 5, change "as different" to --as a different--,
line 12, change "oval, track," to --oval track,--,
line 37, change "cruved" to --curved--.

UNITED STATES PATENT AND TRADEMARK OFFICE

CERTIFICATE OF CORRECTION

PATENT NO. : 5,048,841

DATED : September 17, 1991

INVENTOR(S) : Manney et al

It is certified that error appears in the above-identified patent and that said Letters Patent is hereby corrected as shown below:

Column 4, line 54, change "4 randomly" to --4 to randomly--,
line 64, delete "also" (first occurrence).

Column 8, line 31 (claim 3, line 2) change "wherein;" to --wherein:-- ,
line 37 (claim 4, line 2) change "wherein;" to --wherein:--.

Column 9, line 11 (claim 9, line 7) change "free" to --freely--,
line 49 (claim 12, line 24) change "lane every" to --lane any--.

In the Abstract, line 3 change "course of depicted" to --course depicted--,

Signed and Sealed this

Ninth Day of March, 1993

*Attest:*

STEPHEN G. KUNIN

*Attesting Officer*

*Acting Commissioner of Patents and Trademarks*